US005665264A

United States Patent [19]

Sato et al.

[11] Patent Number: 5,665,264

[45] Date of Patent: Sep. 9, 1997

[54] SUBMERGED NOZZLE MOUNTING/ DISMOUNTING APPARATUS

[75] Inventors: Mitsukuni Sato, Okayama; Kenji Yamamoto, Akaiwa-Gun; Koji Ishii, Okayama; Koichi Ozawa, Chiyoda-Ku; Taizo Sera, Chiyoda-Ku; Jun Kubota, Chiyoda-Ku, all of Japan

[73] Assignee: Shinagawa Shirorenga Kabushiki Kaisha, Tokyo-To, Japan

[21] Appl. No.: 510,512

[22] Filed: Aug. 2, 1995

[30] Foreign Application Priority Data

Aug. 10, 1994 [JP] Japan ..... 6-188591

[51] Int. Cl.[6] ..... B22D 41/56

[52] U.S. Cl. ..... 222/607; 266/DIG. 1

[58] Field of Search ..... 266/236, DIG. 1, 266/287; 222/606, 607, 590, 591

[56] References Cited

U.S. PATENT DOCUMENTS

| | | | |
|---|---|---|---|
| 4,131,220 | 12/1978 | Bode, Jr. et al. | 222/607 |
| 4,316,561 | 2/1982 | Grosko | 222/607 |
| 4,381,102 | 4/1983 | King | 222/607 |
| 5,180,536 | 1/1993 | Bruckner et al. | 222/606 |

FOREIGN PATENT DOCUMENTS

| | | | |
|---|---|---|---|
| 362282769 | 12/1987 | Japan | 266/DIG. 1 |

*Primary Examiner*—Scott Kastler
*Attorney, Agent, or Firm*—Ladas & Parry

[57] ABSTRACT

A submerged nozzle mounting/dismounting apparatus for mounting a submerged nozzle (9) on and dismounting the same from a slide valve device (5) of a molten metal vessel (1) of a continuous casting system, is provided with a submerged nozzle holding mechanism (25) having support arms (27) for holding the submerged nozzle pressed against the slide valve device through mounting pins (13) on the upper part of the submerged nozzle. For automated operation to eliminate all kinds of heavy physical work in a hot environment, the submerged nozzle mounting/dismounting apparatus comprises a slide base (32) laterally slidably mounted for positional adjustment relative to the support arms (27) on a robot arm (21) supported for turning on a stand. A submerged nozzle hanger (40) is provided for supporting the submerged nozzle via support pins (14) projecting from the submerged nozzle. The hanger (40) is pivotally supported for turning in a vertical plane on the slide base. A guide member (45) provided below the slide valve device operates to guide the submerged nozzle hanger (40) for turning in a vertical plane and to guide the slide base through the submerged nozzle hanger for movement in directions perpendicular to the vertical plane in which the submerged nozzle hanger turns. A contact mechanism (46) is supported on the submerged nozzle hanger so as to move along guide surfaces (48, 49) of the guide member. The contact mechanism (46) is guided along the guide surfaces to move the mounting pins (13) of the submerged nozzle on the submerged nozzle hanger into pin receiving grooves (28) of the support arms (27) and to adjust the horizontal positions of the mounting pins (13) so as to be in alignment with the positions of the support arms (27).

11 Claims, 9 Drawing Sheets

SUBMERGED NOZZLE MOUNTING/ DISMOUNTING APPARATUS

BACKGROUND OF THE INVENTION

1. Field of the Invention

The present invention relates to a submerged nozzle mounting/dismounting apparatus for mounting a submerged nozzle on and dismounting the same from a molten metal vessel, such as a ladle or a tundish, in a continuous metal casting system.

2. Description of the Prior Art

The continuous metal casting system has a molten metal vessel such as a ladle or tundish. The molten metal vessel is provided with a slide valve device on and below the bottom wall of the vessel. The slide valve device comprises a bottom plate and a slide plate that is slidable relative to the bottom plate. The bottom plate and the slide plate have holes, respectively, through which molten metal in the molten metal vessel is caused to flow down. By suitably adjusting the position of the slide plate relative to the bottom plate, the degree of overlap of the holes of the two plates changes so that the flowrate of the molten metal flowing down the holes can be adjusted.

A submerged nozzle extends downward and is supported by a submerged nozzle holding mechanism provided below the slide valve device. The molten metal flowing down through the slide valve device is caused to flow into and through the submerged nozzle. The submerged nozzle is removably mounted to the slide valve. The submerged nozzle must be mounted to the slide valve when assembling the continuous casting system, while the submerged nozzle must be dismounted from the slide valve when the submerged nozzle is impaired.

Since the submerged nozzle is formed of bricks and is heavy, the entirely manual work for mounting and dismounting the submerged nozzle is hard and troublesome, and is undesirable in view of working conditions, because the submerged nozzle mounting and dismounting work needs to be carried out in the hot environment around the side valve device and requires heavy physical labor.

When replacing an eroded submerged nozzle with a new one using a mechanical mounting/dismounting means, the molten metal vessel loaded on a car is conveyed to a workshop, and the car mounted with the molten metal vessel is stopped at a predetermined position. Then, the eroded submerged nozzle is dismounted from the slide valve device, and then a new submerged nozzle is mounted on the slide valve device. However, in most cases, the position on the slide valve device at which the submerged nozzle is attached to the slide valve device does not coincide with the position of the submerged nozzle on the mechanical mounting/dismounting means and, consequently, the final positional adjustment of the mechanical mounting/dismounting means relative to the mounting position on the slide valve device must be carried out visually when mounting the submerged nozzle on or dismounting the same from the slide valve device. The operators must carry out this positional adjustment of the mechanical mounting/dismounting means unavoidably in a hot environment around the molten metal vessel.

SUMMARY OF THE INVENTION

Accordingly, it is an object of the present invention to provide a submerged nozzle mounting/dismounting apparatus capable of automatically adjusting the position of a submerged nozzle to a predetermined position without requiring manual work when mounting or dismounting the submerged nozzle and capable of completely eliminating heavy manual work in a hot environment.

With the foregoing object in view according to the present invention, there is provided a submerged nozzle mounting/dismounting apparatus for mounting a substantially vertical submerged nozzle on and dismounting the same from a slide valve device which is provided on and below a bottom wall of a molten metal vessel and through which a molten metal in the vessel flows downward into and through the submerged nozzle, wherein the apparatus comprising a submerged nozzle holding mechanism provided below the slide valve device and having substantially horizontally extending support arms for supporting mounting pins provided on an upper part of the submerged nozzle for holding the submerged nozzle pressed against the slide valve device, the submerged nozzle mounting/dismounting apparatus comprising: a robot arm; submerged nozzle support means mounted on the robot arm for supporting the submerged nozzle through support pins provided on the submerged nozzle, the nozzle support means being capable of horizontal sliding movement in a direction across the support arms of the submerged nozzle holding mechanism for horizontal positional adjustment of the submerged nozzle and being capable of vertical movement for vertical positional adjustment of the submerged nozzle; a guide member fixedly provided below the slide valve device and having an upper guide surface and a side guide surface; and a contact mechanism provided on said submerged nozzle support means and having contact means for contacting and being guided along the upper guide surface and the side guide surface to enable the submerged nozzle supported on the submerged nozzle support means to be adjusted in horizontal position relative to the support arms and to be vertically moved for mounting the support pins of the submerged nozzle onto the support arms and for dismounting the support pins from the support arms.

The submerged nozzle support means may comprise a slide base mounted on the robot arm for sliding movement in a direction across the support arms of the submerged nozzle holding mechanism; and a submerged nozzle hanger mounted on the slide base for supporting the submerged nozzle through the support pins on the submerged nozzle and for turning movement in a vertical plane.

The slide base may be resiliently urged in a direction of the sliding movement. Further, the submerged nozzle hanger may be pivotally mounted at an end thereof on the slide base. The submerged nozzle hanger may comprise pillow blocks fixed thereto for supporting the support pins of the submerged nozzle.

The contact mechanism may comprise a roller capable of rolling in a vertical plane along the upper guide surface of the guide member, and at least one roller capable of rolling in a horizontal plane along the side guide surface of the guide member.

Pin receiving grooves may be formed in extremities of the support arms of the submerged nozzle holding mechanism to receive mounting pins on the submerged nozzle, the grooves being formed substantially in a U-shape so as to open in the extremities of the support arms, whereby upper protruding portions defining the pin receiving grooves operate to depress, when dismounting the submerged nozzle, the mounting pins to forcibly move the submerged nozzle away from the slide valve device.

When mounting the submerged nozzle on the molten metal vessel, the molten metal vessel is mounted on a car or the like, and the car travels to a predetermined place. The car is stopped at a predetermined position. However, the car is not always stopped in such a way that the slide valve device provided to the bottom wall of the molten metal vessel is located accurately at a given position. After the car has been stopped at the predetermined position, the submerged nozzle holding mechanism is actuated to lower the support arms, the submerged nozzle hanger mounted on the robot arm is brought into engagement with support pins of the submerged nozzle to hold the submerged nozzle, and then the robot arm is operated to move linearly toward the extremities of the support arms of the submerged nozzle holding mechanism. The contact mechanism held on the submerged nozzle hanger is guided by the guide member, so that the mounting pins of the submerged nozzle are raised to positions above the level of the support arms of the submerged nozzle holding mechanism, and the slide base slides horizontally relative to the support arms and comes into alignment with the support arms. The robot arm is thus moved to cause the mounting pins of the submerged nozzle to come near to the support arms, the contact mechanism moves further along guide surfaces of the guide member to seat the mounting pins of the submerged nozzle in pin receiving grooves of the support arms so that the submerged nozzle is supported on the support arms. Then, the robot arm is returned to its original position, the submerged nozzle holding mechanism is actuated to raise the support arms so that the upper end of the submerged nozzle is pressed against the slide valve device to keep the submerged nozzle joined to the slide valve device. Those submerged nozzle mounting steps are reversed when dismounting the submerged nozzle from the slide valve device.

The submerged nozzle mounting/dismounting apparatus may be provided with a spare submerged nozzle stand and a preheating stand. In this case, the robot arm operates to take up a submerged nozzle from the spare submerged nozzle stand and transfers the submerged nozzle to submerged nozzle suspending members of the preheating stand. Then, a preheating pot is raised to receive therein the submerged nozzle suspended by the submerged nozzle suspending members, and burners are operated to preheat the submerged nozzle. The burners are stopped after the submerged nozzle has been preheated, and the preheating pot is lowered. Then, the robot arm is turned to a position corresponding to the preheating stand, the submerged nozzle hanger is brought into alignment with support pins of the submerged nozzle by cooperative action of the guide member and the contact mechanism to support the submerged nozzle by the support pins, and the robot arm transfers the submerged nozzle to a submerged nozzle mounting position. Thus the submerged nozzle mounting operation is executed.

The rollers of the contact mechanism roll along the guide surfaces of the guide member to enable the contact mechanism to move smoothly. In the case where the pin receiving grooves of the support arms for supporting the submerged nozzle by the support pins are formed substantially in a U-shape and the upper protruding portions of the extremities of the support arms extend over the mounting pins, the submerged nozzle can be forcibly moved away from the slide valve device, when dismounting the submerged nozzle from the slide valve, even if the upper end of the submerged nozzle is seized by the molten metal.

The above and other objects, features and advantages of the present invention will become more apparent from the following description taken in connection with the accompanying drawings.

DESCRIPTION OF THE PREFERRED EMBODIMENTS

Prior to the description of the present invention, the prior art mentioned hereinbefore will be described with reference to the drawings, for a better understanding of the nature of the present invention.

Figure 12:
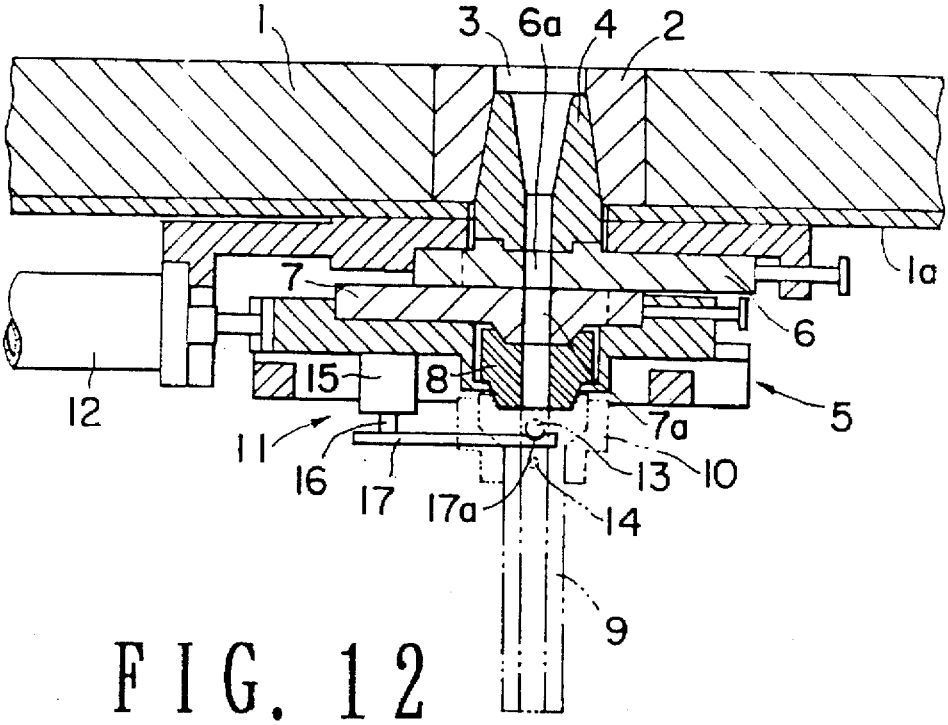
FIG. 12 PRIOR ART
FIG. 12 is a schematic sectional view of a known slide valve device.

As shown, in a sectional view in FIG. 12, a molten metal vessel 1, such as a ladle or a tundish, has a bottom wall 1*a* provided with a nozzle seating block 2 having a tap hole 3, an insert nozzle 4 is inserted in the tap hole 3, and a slide valve device 5 of a two-layer type having a bottom plate 6 and a slide plate 7 is joined to the lower surface of the bottom wall 1*a* of the molten metal vessel 1. The insert nozzle 4 is seated on the upper surface of the bottom plate 6 of the slide valve device 5 so that the nozzle hole of the insert nozzle 4 coincides with a hole 6*a* formed in the bottom plate 6. A lower nozzle 8 is joined to the lower surface of the slide plate 7 of the slide valve device 5, and a nozzle case 10 fixedly fastened to a submerged nozzle 9 is held by a submerged nozzle holding mechanism 11 so that the submerged nozzle 9 is joined to the lower nozzle 8. A hydraulic cylinder actuator 12 slides the slide plate 7 laterally to regulate the discharge rate of the molten metal by controlling the degree of coincidence of the hole 7*a* of the slide plate 7 with the hole 6*a* of the bottom plate 6.

The nozzle case 10 fixedly houses therein the top enlarged part of the submerged nozzle 9 and an upper portion of a reduced part of the submerged nozzle 9 extending from the lower end of the top enlarged part. A pair of mounting pins 13 project diametrically opposite to each other from the upper part of the nozzle case 10, and a pair of support pins 14 project diametrically opposite to each other from the lower part of the nozzle case 10. When conveying, mounting or dismounting the submerged nozzle 9, the nozzle case is supported by the support pins 14. The submerged nozzle holding mechanism 11 holds the nozzle case 10 by the mounting pins 13 to secure the submerged nozzle 9 in place.

As shown schematically in FIG. 12, the submerged nozzle holding mechanism 11 is provided with a pair of support arms 17 each provided in the upper surface of its extremity with a pin receiving groove 17*a* for receiving the mounting pin 13 therein, and a pneumatic or hydraulic cylinder actuator 15 for vertically moving the support arms 17, fixedly attached to the lower part of the slide valve device 5 or the lower surface of the molten metal vessel 1. The operating rod of the cylinder actuator 15 is retracted to raise the support arms 17 so that the submerged nozzle 9 is raised and the upper end of the submerged nozzle 9 is firmly pressed against the lower surface of the lower nozzle 8 of the slide valve device 5. The submerged nozzle 9 is preheated before being mounted on the slide valve device 5 or after being mounted on the slide valve device 5. The submerged nozzle 9 is mounted on and dismounted from the slide valve device 5 by entirely manual work of the operators, by manual work of the operators using an auxiliary apparatus, such as a linkage disclosed in Japanese Patent Publication (Kokoku) No. 4-28688, or by fully automated operation.

Since the submerged nozzle 9 is formed of bricks and is heavy, the entirely manual submerged nozzle mounting and dismounting work is hard and troublesome, and is undesirable in view of working conditions, because the submerged nozzle mounting and dismounting work needs to be carried out in the hot environment around the slide valve device 5 and requires heavy physical labor.

When replacing an eroded submerged nozzle 9 with a new one using a mechanical mounting/dismounting means, the molten metal vessel 1 loaded on a car is conveyed to a workshop, and the car mounted with the molten metal vessel 1 is stopped at a predetermined position. Then, the eroded submerged nozzle 9 is dismounted from the slide valve device 5, and then a new submerged nozzle 9 is mounted on the slide valve device 5. However, in most cases, the position on the slide valve device 5 at which the submerged nozzle 9 is attached to the slide valve device does not coincide with the position of the submerged nozzle 9 on the mechanical mounting/dismounting means and, consequently, the final positional adjustment of the mechanical mounting/dismounting means relative to the mounting position on the slide valve device 5 must be carried out visually when mounting the submerged nozzle 9 on or dismounting the same from the slide valve device 5. The operators must carry out this positional adjustment of the mechanical mounting/dismounting means unavoidably in a hot environment around the molten metal vessel 1.

Figure 13:
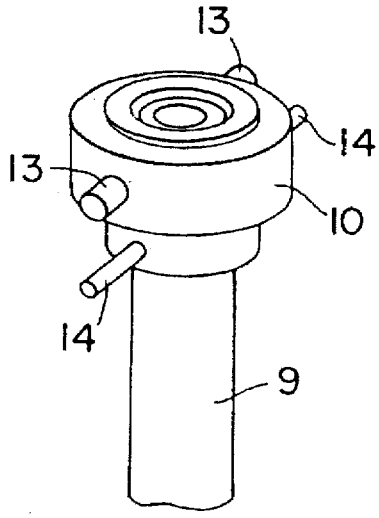
FIG. 13 PRIOR ART
FIG. 13 is a perspective view of a nozzle case holding a submerged nozzle used in the device of FIG. 12.

The above stated problems in the prior art can be solved by the present invention, which will be described in detail below with respect to preferred embodiments thereof with reference to FIGS. 1 to 11, in which parts like or corresponding to those previously described with reference to FIGS. 12 and 13 are designated by the same reference characters.

Figure 1:
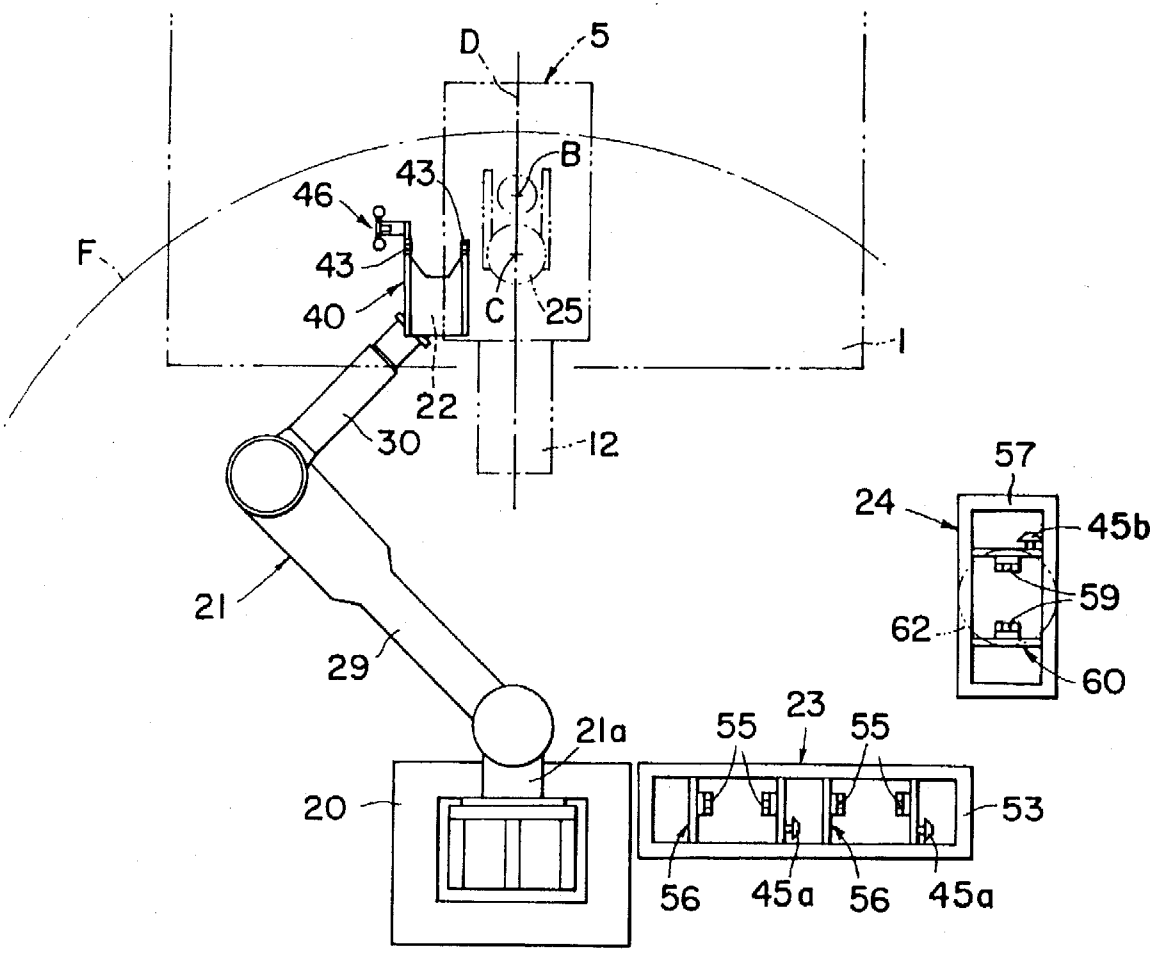
FIG. 1 is a schematic plan view of a submerged nozzle mounting/dismounting apparatus in a preferred embodiment according to the present invention.

Referring to FIG. 1 showing a plan view of a submerged nozzle mounting/dismounting apparatus in a preferred embodiment according to the present invention, a slide valve device 5 is attached to the bottom wall 1*a* of a molten metal vessel 1. A robot arm 21 included in a general-purpose three-axis articulated robot has a base end 21*a* supported on a stand 20 spaced horizontally apart from the slide valve device 5, and a support head 22 is joined to the extremity of the robot arm 21. A spare submerged nozzle stand 23 and a preheating stand 24 are arranged within the turning range of the robot arm 21.

Figure 2:
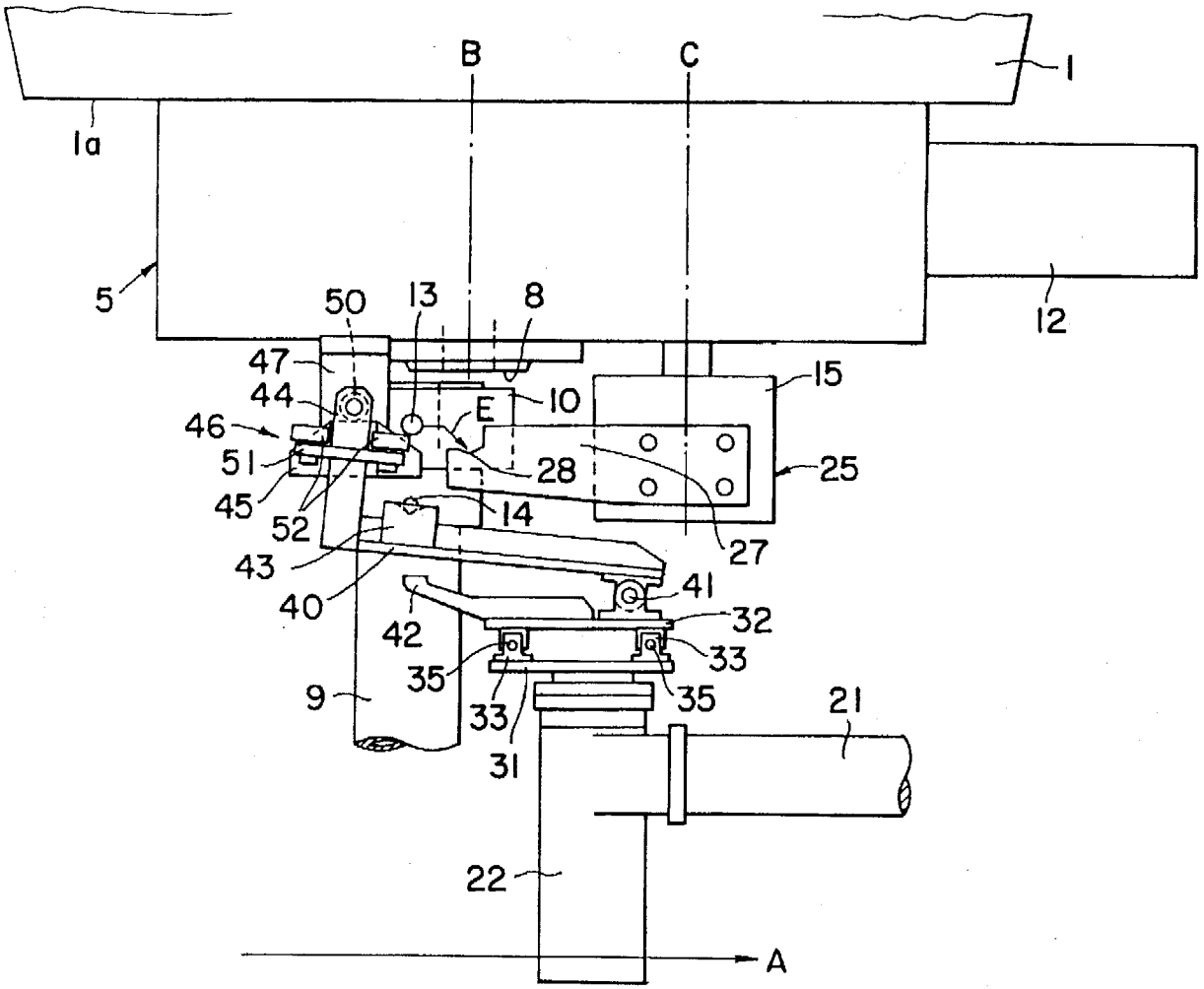
FIG. 2 is a schematic side view of an essential portion of the submerged nozzle mounting/dismounting apparatus of FIG. 1 in a state immediately before transferring a submerged nozzle to a submerged nozzle holding mechanism.
Figure 8:
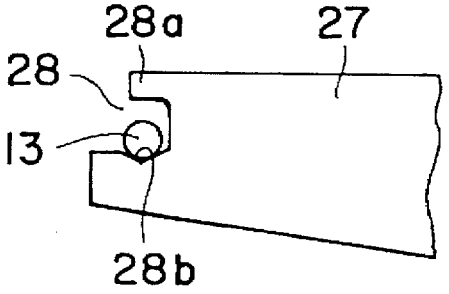
FIG. 8 is a schematic fragmentary side view of a modification of the extremity of a support arm included in a submerged nozzle holding mechanism.

As shown in FIG. 2, a submerged nozzle holding mechanism 25 is joined to the lower surface of the slide valve device 5. The submerged nozzle holding mechanism 25 is provided, similarly to the conventional submerged nozzle holding mechanism, with a pneumatic cylinder actuator 15. The submerged nozzle holding mechanism 25 may be provided with a hydraulic cylinder actuator or a toggle linkage instead of the pneumatic cylinder actuator 15. A pair of support arms 27 are attached in a horizontal position to the cylinder actuator 15 so as to extend under the lower nozzle 8 of the slide valve device 5 leaving a space capable of receiving the upper part of a nozzle case 10 holding a submerged nozzle 9 therebetween. Pin receiving grooves 28 for receiving the mounting pins 13 of the nozzle case 10 are formed in the upper surfaces of the extremities of the support arms 27, respectively. Each pin receiving groove 28 is formed by cutting the upper portion of the extremity of the corresponding support arm 27 in an L-shape, and a recess 28*b* (FIG. 8) is formed in the inner end of the horizontal bottom surface of the pin receiving groove 28 to correctly position and hold the mounting pin 13 in place. Each pin receiving groove 28 may be a U-shaped groove, as shown in FIG. 8, opening toward the front so that the upper portion of the extremity of the support arm 27 protrude in the form of a protrusion 28*a*. When dismounting the submerged nozzle 9 from the slide valve device 5, the protrusions 28*a* of the support arm 27 depresses the mounting pins 13 to separate the submerged nozzle 9 forcibly from the lower nozzle 8 of the slide valve device 8 even if the upper end of the submerged nozzle 9 is seized by the lower nozzle 8 by a molten metal adhering to the lower nozzle 8.

Figure 9:
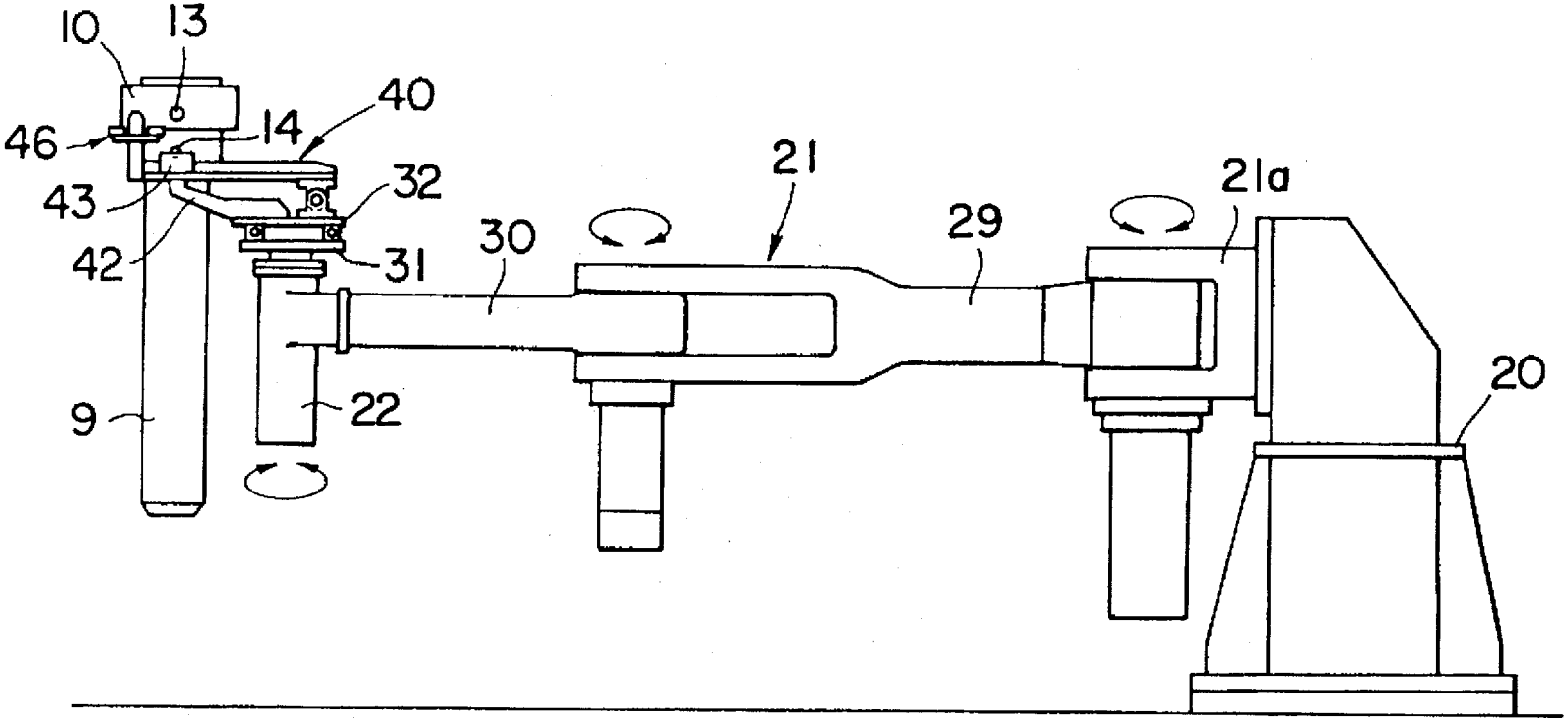
FIG. 9 is a schematic side view of a robot arm.

As shown in FIG. 9, the robot arm 21 comprises a robot base arm 29 and a robot forearm 30. A base plate 31 is fixed to the upper surface of the support head 22 joined to the robot forearm 30, and a slide base 32 is supported for sliding movement in directions perpendicular to a direction in which the support arms 27 are extended on the base plate 31.

Figure 4:
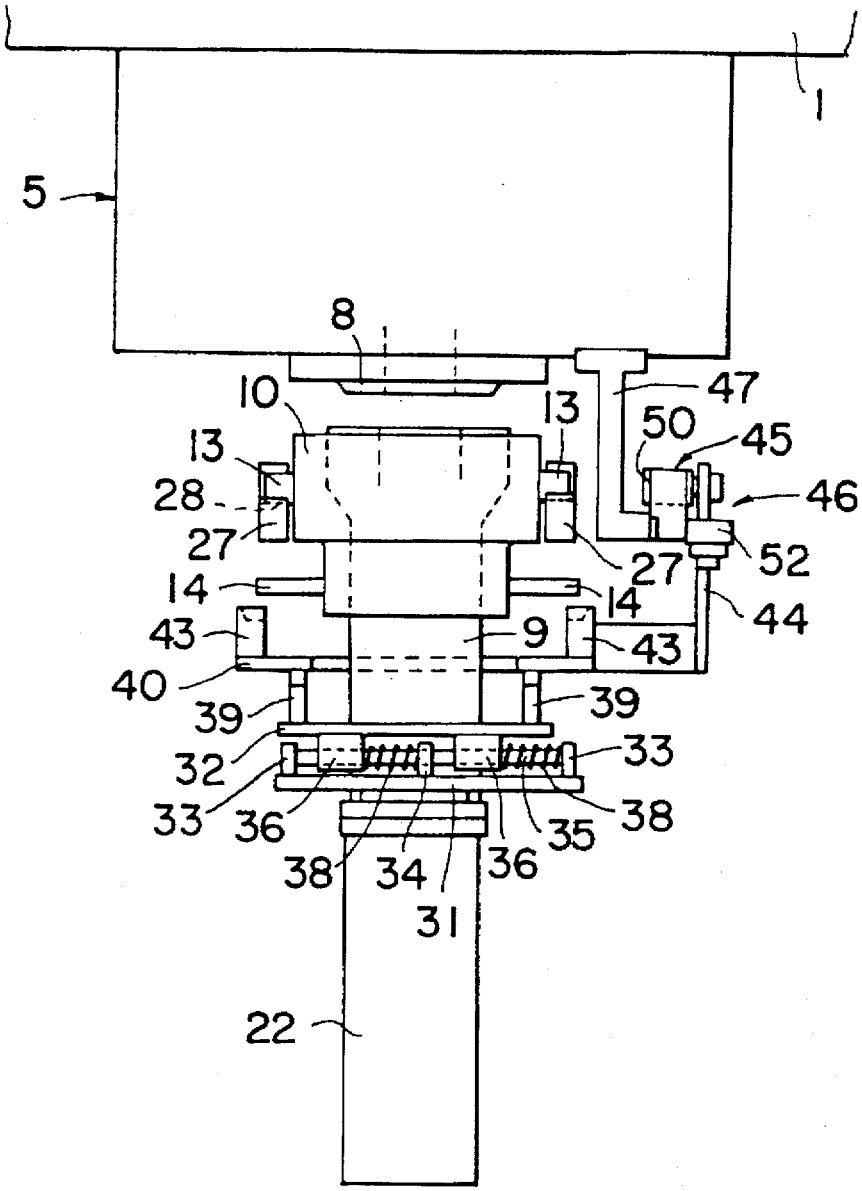
FIG. 4 is a schematic front view of the portion shown in FIG. 3.
Figure 5:
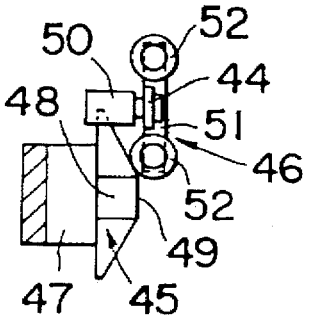
FIG. 5 is partly sectional plan view of a guide member and a contact mechanism.

FIG. 4 shows a slide base driving mechanism for driving the slide base 32 for sliding movement. This mechanism comprises two parallel guide rods 35 (FIG. 2) each supported on two end brackets 33 and a middle bracket 34 formed on the base plate 31, sliders 36 attached to the lower surface of the slide base 32 and axially slidably mounted on the guide rods 35, compression springs 38 wound around the guide rod 35 and extended between the one end bracket 33 and the one of the sliders 36 and between the other slider 36 and the middle bracket 34, respectively, to bias the slide base 32 continuously to the left, as viewed in FIG. 4.

Figure 3:
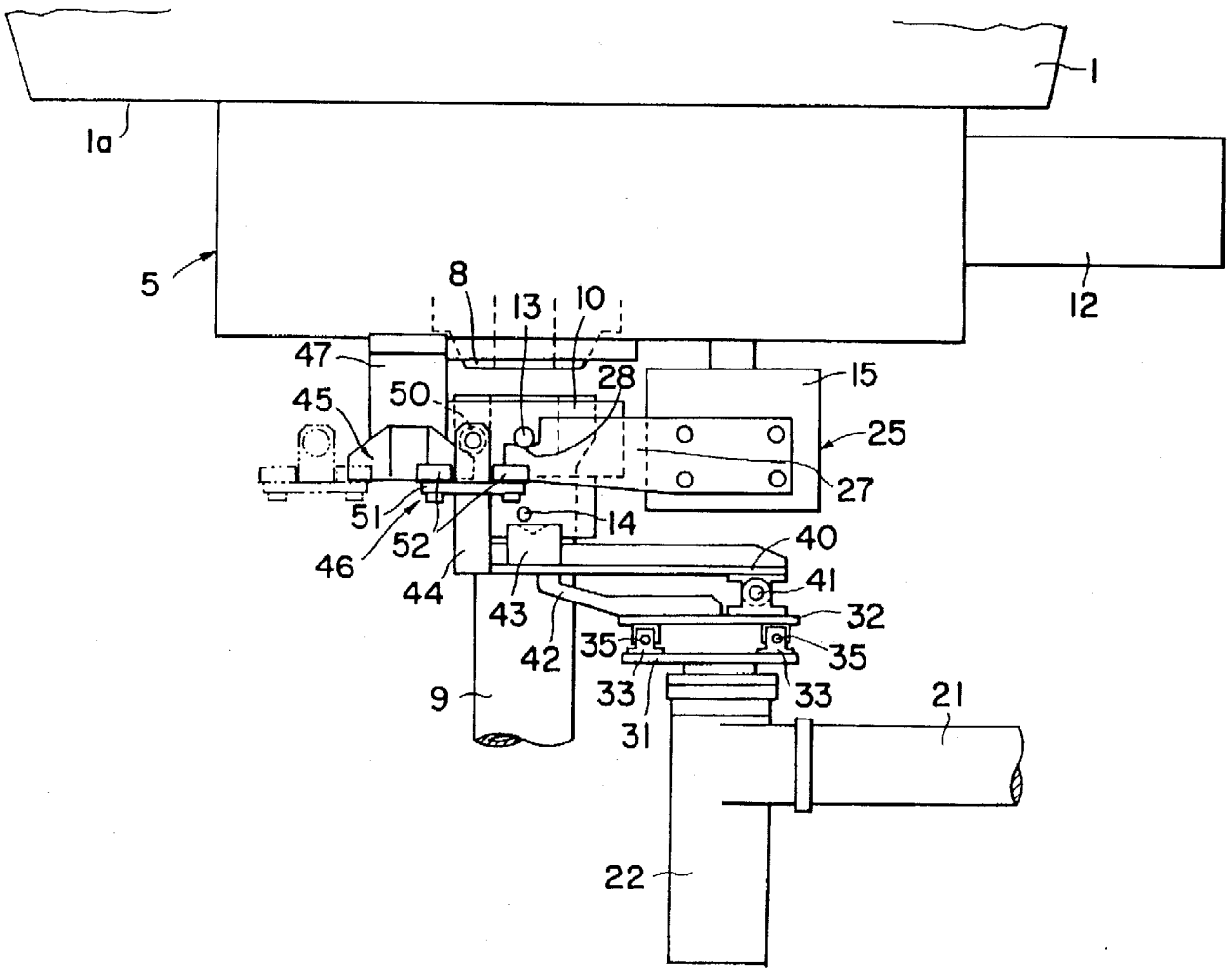
FIG. 3 is a schematic side view, similar to FIG. 2, of the essential portion of the submerged nozzle mounting/dismounting apparatus of FIG. 1 in a state immediately after transferring the submerged nozzle to the submerged nozzle holding mechanism.

As shown in FIG. 2, a submerged nozzle hanger 40 (hereinafter referred to simply as "hanger") has a base part supported on a shaft 41 supported on brackets 39 (FIG. 4) attached to the upper surface of the slide base 32 so that the hanger 40 is able to turn in a vertical plane on the shaft 41. Normally, the hanger 40 rests in a substantially horizontal position on a stopper 42 attached to the slide base 32 as indicated in FIG. 3. The free end of the hanger 40 is bifurcated into two arms to form a space capable of receiving the upper part of the nozzle case 10 therein between the arms, and pillow blocks 43 are mounted on the extremities of the arms of the hanger 40, respectively. The pillow blocks 43 are provided with pin receiving grooves of V-shaped cross-section for receiving support pins 14 attached to the nozzle case 10 therein. A post 44 is set upright on the front side of the pillow blocks 43, and a contact mechanism 46 is supported on the upper end of the post 44 so as to move along a guide member 45 suspended from the slide valve device 5. The slide base 32 and the submerged nozzle hanger 40 pivotally mounted thereon constitute a support means for the submerged nozzle 9.

Figure 6:
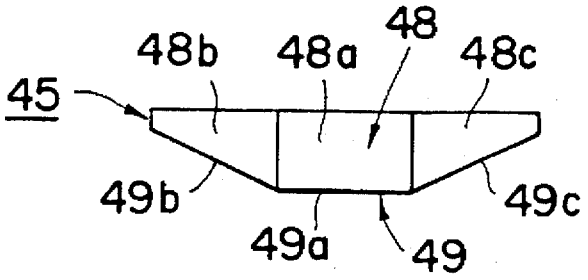
FIG. 6 is a schematic plan view of the guide member of FIG. 5.
Figure 7:
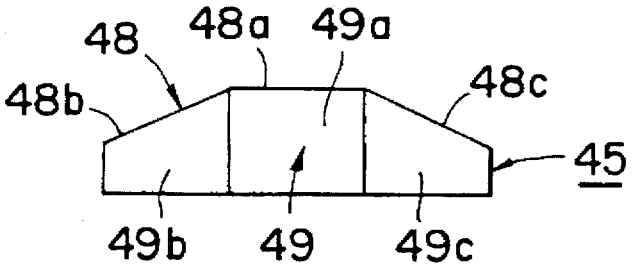
FIG. 7 is a schematic front view of the guide member of FIG. 5.

The guide member 45 is fastened to a side surface of a support member 47 fixed to the lower surface of the slide valve device 5. As shown in FIGS. 6 (top view) and 7 (front view), the guide member 45 has an upper guide surface 48 consisting of a middle section 48*a* of a desired length and the largest height, and inclined sections 48*b* and 48*c* declining toward the opposite ends of the guide member 45 from the opposite ends of the middle section 48*a*, respectively, and a side guide surface 49 consisting of a middle section 49*a* of a desired length and the largest height, and inclined sections 49*b* and 49*c* declining toward the opposite ends of the guide member 40 from the opposite ends of the middle section 49*a*, respectively.

The contact mechanism 46 is supported on the upper end of the post 44 of the hanger 40, and is provided with a top roller 50 supported for rolling along the upper guide surface 48 in a vertical plane and two side rollers 52 (FIG. 5) supported on the opposite ends, respectively, of a support arm 51 fixed to the post 44 for rolling along the side guide surface 49 in a horizontal plane.

When the robot arm 21 is operated to move the support head 22 toward the extremities of the support arms 27, i.e., in the direction of the arrow A shown in FIG. 2, the top roller 50 rolls along the upper guide surface 48 of the guide member 45, and the side rollers 52 roll along the side guide surface 49 of the guide member 45. Consequently, the contact mechanism 46 is moved vertically and horizontally according to the contours of the guide surfaces 48 and 49 of the guide member 45, and the sloping angle of the hanger 40 varies while the position of the slide base 32 with respect to a direction parallel to the axes of the guide rods 35 varies accordingly. Consequently, the mounting pins 13 of the nozzle case 10 are aligned with the pin receiving grooves 28 of the support arms 27, respectively, or the support pins 14 of the nozzle case 10 are aligned with the pillow blocks 43 on the hanger 40, respectively.

Figure 10:
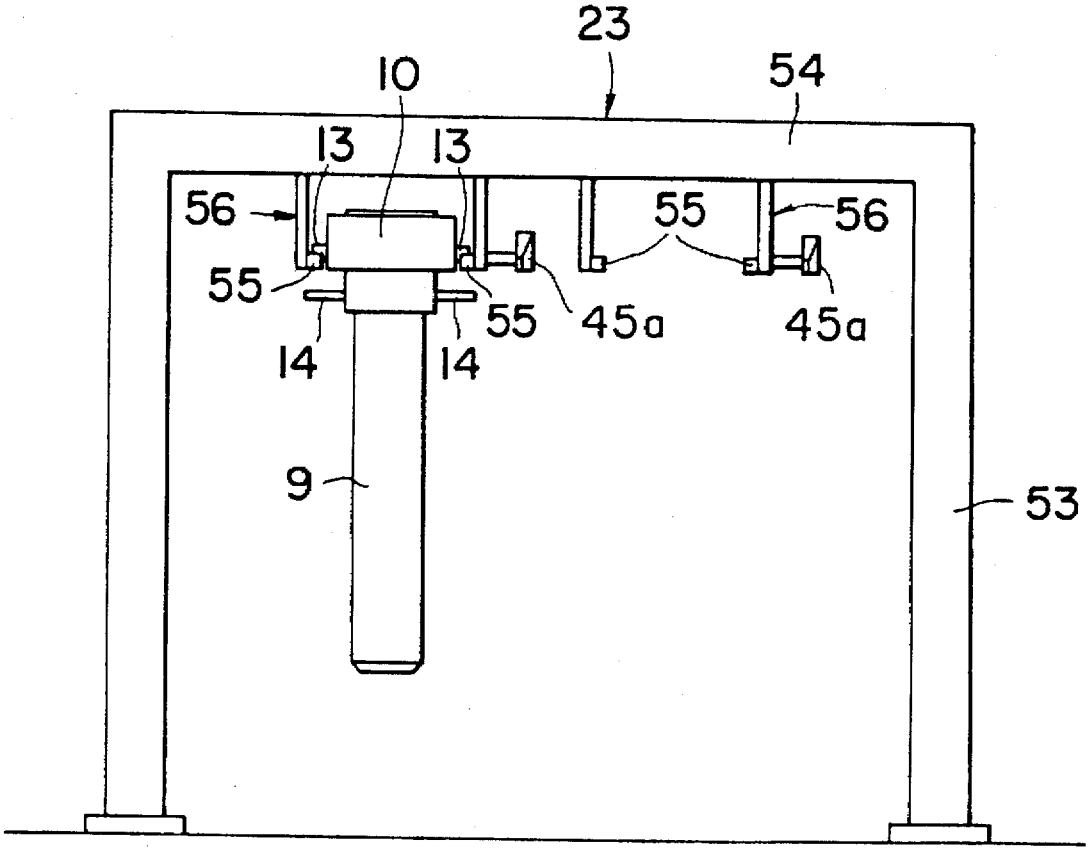
FIG. 10 is a schematic front view of a spare submerged nozzle stand by way of example.

Referring to FIG. 10, the spare submerged nozzle stand 23 comprises a gantry frame 53, pairs of hanging bars 56 each having a pin supporting part 55 for supporting the mounting pin 13 of the nozzle case 10. The hanging bars 56 are hung from the upper beam 54 of the gantry frame 53. The stand 23 further comprises guide members 45*a*, which are identical with the guide member 45, each supported on one hanging bar 56 of each pair of hanging bars 56. In this embodiment, the spare submerged nozzle stand 23 is provided with two pairs of hanging bars 56 to store two submerged nozzles 9.

Figure 11:
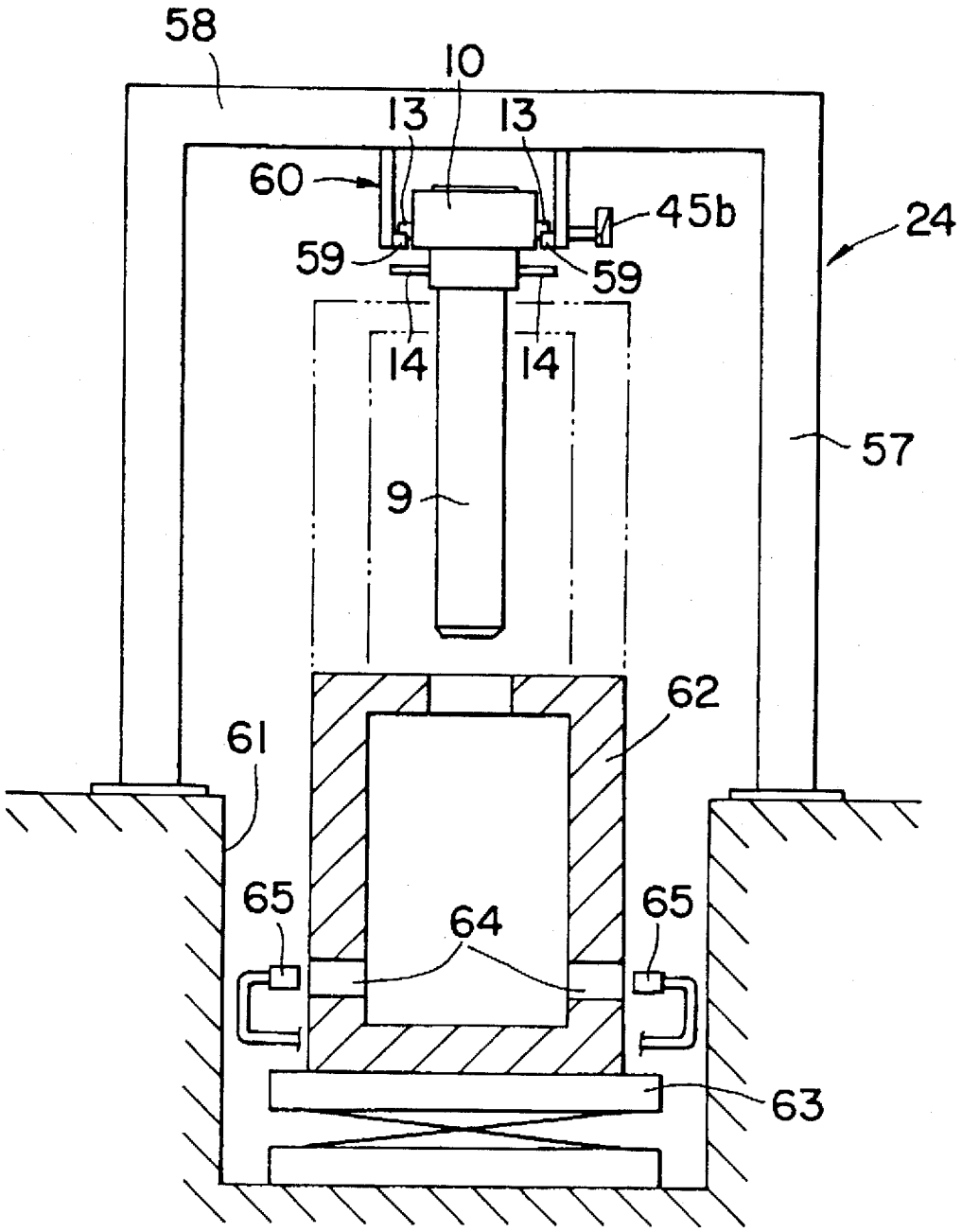
FIG. 11 is a partly sectional front view of a submerged nozzle preheating stand by way of example.

The preheating stand 24 (FIG. 1) heats the submerged nozzle 9 for preheating immediately before joining the submerged nozzle 9 to the lower nozzle 8 of the slide valve device 5 to avoid sharply heating the submerged nozzle 9 by the molten metal when the submerged nozzle 9 is joined to the lower nozzle 8 of the slide valve device 5. As shown in FIG. 11, the preheating stand 24 comprises a gantry frame 57, a pair of suspending bars 60, which are identical with the hanging bars 56 of the spare submerged nozzle stand 23, each having a pin supporting part 59 and hung from the upper beam 58 of the gantry frame 57, and a guide member 45*b* supported on one of the support bars 60. A preheating pot 62 is mounted on a lifting mechanism 63 in a pit 61 formed directly below the submerged nozzle 9 as suspended from the suspending bars 60. When the pot 62 is raised by the lifting mechanism 63 to a working position indicated by alternate long and two short dashes lines in FIG. 11, most part of the submerged nozzle 9 suspended from the suspending bars 60 is received in the pot 62. Burner holes 64 are formed in the side walls of the pot 62, respectively, and preheating burners 65 are disposed in alignment with the burner holes 64, respectively. After the pot 62 has been raised to the working position to receive the submerged nozzle therein, the burners 65 are started to preheat the submerged nozzle 9.

Although the spare submerged nozzle stand 23 and the preheating stand 24 are installed separately in this embodiment, the preheating stand 24 may be omitted and a preheating pot 62 may be installed in the spare submerged nozzle stand 23 for each submerged nozzle 9 stored in the spare submerged nozzle stand 23. If there is a deck or the like available for suspending submerged nozzles at a position corresponding to the gantry frame, the gantry frame may be omitted. In FIG. 1, indicated at F is the limit of the turning range of the support head 22 joined to the extremity of the robot arm 21.

When mounting the submerged nozzle 9 on the slide valve device 5, the molten metal vessel 1 mounted on a car or the like is carried to a predetermined position shown in FIG. 1. The cylinder actuator 15 of the submerged nozzle holding mechanism 25 is actuated to lower the support arms 27, and the submerged nozzle 9 is hung from the hanger 40 supported on the support head 22 joined to the extremity of the robot arm 21 with the support pins 14 of the nozzle case 10 resting on the pillow blocks 43. Then, the robot arm 21 is operated so as to move the support head 22 linearly, i.e., along a center line D crossing the axis B of the lower nozzle 8 and the axis C (FIG. 1) of the cylinder actuator 15 of the submerged nozzle holding mechanism 25 toward the extremities of the support arms 27 of the submerged nozzle holding mechanism 25, i.e., the direction of the arrow A in FIG. 2. When the support head 22 is thus moved, the upper roller 50 of the contact mechanism 46 supported on the extremity of the hanger 40 rolls along the upper guide surface 48 of the guide member 45, and the side rollers 52 of the contact mechanism 46 roll along the side guide surface 49 of the guide member 45. As the roller 50 rolls from the inclined section 48*b* onto the middle section 48*a* as shown in FIG. 2, the hanger 40 is turned clockwise, as viewed in FIG. 2, about the shaft 41, so that the mounting pins 13 of the nozzle case 10 are raised to a level above the level of the pin receiving grooves 28 of the support arms 27 of the submerged nozzle holding mechanism 25. As the side rollers 52 roll on the middle section 49*a* of the side guide surface 49 of the guide member 45, the slide base 32 slides to the right, as viewed in FIG. 4 so that the axis of the submerged nozzle 9 is located on the center line D. As the support head 22 joined to the extremity of the robot arm 21 moves further in the direction of the arrow A on the center line D, the upper roller 50 of the contact mechanism 46 rolls from the middle section down to the declining inclined section 48*c*, and the extremity of the hanger 40 moves down accordingly. Consequently, the mounting pins 13 of the nozzle case 10 holding the submerged nozzle 9 drop into the pin receiving grooves 28 of the support arms 27, respectively, as indicated by the arrow E in FIG. 2. Then, the robot arm 21 is operated to return the support head 22 to its original position, and the operating rod of the cylinder actuator 15 of the submerged nozzle holding mechanism 25 is retracted to raise the support arms 27 so that the upper end of the submerged nozzle 9 is pressed and kept pressed against the lower surface of the lower nozzle 8 of the slide valve device 5 to complete the mounting operation for mounting the submerged nozzle 9 on the slide valve device 5. When dismounting the submerged nozzle 9 from the slide valve device 5, the aforesaid steps are reversed.

When the submerged nozzle mounting/dismounting apparatus is provided with the spare submerged nozzle stand 23 and the preheating stand 24, the support head 22 joined to the extremity of the robot arm 21 is moved to the spare submerged nozzle stand 23, and then the support head 22 is moved toward a position corresponding to the intermediate position between the pair of suspending bars 56 of the spare submerged nozzle stand 23. Then, the pillow blocks 43 of the hanger 40 are brought into engagement with the support pins 14 of the nozzle case 10 holding the submerged nozzle 9 by the cooperative action of the guide member 45*a* and the contact mechanism 46 so that the support pins 14 are supported on the pillow blocks 43. Then, the robot arm 21 is operated to move the support head 22 to the preheating stand 24 and to move the support head 22 toward a position corresponding to the intermediate position between the pair of suspending bars 60. Consequently, the mounting pins 13 are seated on the pin supporting parts 59 by the cooperative action of the guide member 45*b* and the contact mechanism 46. Then, after retracting the support head 22 from the position corresponding to the intermediate position between the pair of suspending bars 60, the lifting mechanism 63 is actuated to raise the pot 62 so that the submerged nozzle 9 is received in the pot 62, and then the burners 65 are started to preheat the submerged nozzle 9. After the completion of the preheating of the submerged nozzle 9, the burners 65 are stopped, the pot 62 is lowered, the preheated submerged nozzle 9 is hung from the hanger 40 supported on the support head 22 joined to the extremity of the robot arm 21, and then the foregoing submerged nozzle mounting operation is executed.

The contact members of the contact mechanism 46 need not necessarily be rollers, but may be any suitable contact members such as contact pins. The spare submerged nozzle stand 23 is not necessarily indispensable; the hanger 40 supported on the support head 22 joined to the extremity of the robot arm 21 to a position where the operators are not exposed to the thermal influence of the molten metal vessel 1 and a submerged nozzle may be manually put on the hanger 40. A robot designed specially for use in mounting a submerged nozzle on and dismounting the same from the slide valve device may be used instead of the general-purpose three-axis articulated robot.

As is apparent from the foregoing description, the present invention mounts a submerged nozzle on and dismounts the same from the slide valve device by remote operations using a general-purpose three-axis robot and makes manual work in a hot environment unnecessary to eliminate all kinds of work under harsh working conditions. Since a submerged nozzle held by the nozzle case can be located with the axis thereof accurately aligned with the axis of the lower nozzle of the slide valve device by the cooperative action of the guide member and the contact mechanism even if the molten metal vessel is not located accurately, the submerged nozzle mounting work and the submerged nozzle dismounting work can be efficiently carried out.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A submerged nozzle mounting/dismounting apparatus for mounting a substantially vertical submerged nozzle on and dismounting the same from a slide valve device which is provided on and below a bottom wall of a molten metal vessel and through which a molten metal in said vessel flows downward into and through the submerged nozzle, wherein said apparatus comprises a submerged nozzle holding mechanism provided below said slide valve device and having substantially horizontally extending support arms with receiving means for supporting mounting pins provided on an upper part of the submerged nozzle for holding the submerged nozzle pressed against the slide valve device, said submerged nozzle mounting/dismounting apparatus comprising:

a robot arm;

submerged nozzle support means mounted on said robot arm for supporting the submerged nozzle through support pins provided on the submerged nozzle, said nozzle support means being capable of horizontal sliding movement in a direction across said support arms of the submerged nozzle holding mechanism for horizontal positional adjustment of the submerged nozzle and being capable of vertical movement for vertical positional adjustment of the submerged nozzle;

a guide member fixedly provided below said slide valve device and having an upper guide surface and a side guide surface; and a contact mechanism provided on said submerged nozzle support means and having contact means for contacting and being guided along said upper guide surface and said side guide surface to enable the submerged nozzle supported on said submerged nozzle support means to be adjusted in horizontal position relative to said support arms and to be vertically moved for mounting said mounting pins of the submerged nozzle onto said support arms and for dismounting said mounting pins from said support arms.

2. The submerged nozzle mounting/dismounting apparatus according to claim 1, wherein said submerged nozzle support means comprises:

a slide base mounted on said robot arm for sliding movement in a direction across said support arms of the submerged nozzle holding mechanism; and a submerged nozzle hanger mounted on said slide base for supporting the submerged nozzle through the support pins on the submerged nozzle and for turning movement in a vertical plane.

3. The submerged nozzle mounting/dismounting apparatus according to claim 2, wherein said slide base is resiliently urged in a direction of the sliding movement.

4. The submerged nozzle mounting/dismounting apparatus according to claim 2, wherein said submerged nozzle hanger is pivotally mounted at an end thereof on said slide base.

5. The submerged nozzle mounting dismounting apparatus according to claim 4, wherein said submerged nozzle hanger comprises pillow blocks fixed thereto for supporting said support pins of the submerged nozzle.

6. The submerged nozzle mounting/dismounting apparatus according to claim 1, wherein said contact mechanism comprises a roller capable of rolling in a vertical plane along the upper guide surface of the guide member, and at least one roller capable of rolling in a horizontal plane along the side guide surface of the guide member.

7. The submerged nozzle mounting/dismounting apparatus according to claim 1, further comprising: pin receiving grooves formed in extremities of the support arms of the submerged nozzle holding mechanism to receive mounting pins on the submerged nozzle, said grooves being formed substantially in a U-shape so as to open in the extremities of the support arms, whereby upper protruding portions defining said pin receiving grooves operate to depress, when dismounting the submerged nozzle, the mounting pins to forcibly move the submerged nozzle away from the slide valve device.

8. The submerged nozzle mounting/dismounting apparatus according to claim 1, further comprising: a spare submerged nozzle stand provided within the reach of the robot arm.

9. The submerged nozzle mounting/dismounting apparatus according to claim 8, wherein said spare submerged nozzle stand comprises: a frame, submerged nozzle hanging members having pin seats for supporting mounting pins provided on the submerged nozzle, respectively, and guide members each supported on one side of the submerged nozzle hanging members.

10. The submerged nozzle mounting/dismounting apparatus according to claim 1, further comprising: a submerged nozzle preheating stand provided within the reach of the robot arm.

11. The submerged nozzle mounting/dismounting apparatus according to claim 10, wherein said preheating stand comprises: a frame, a pair of submerged nozzle suspending members respectively having pin seats for supporting mounting pins provided on the submerged nozzle, and a submerged nozzle preheating pot provided for vertical movement directly below the submerged nozzle suspending members of the preheating stand and provided with preheaters for heating the submerged nozzle when the preheating pot is raised to receive the submerged nozzle therein.

* * * * *